United States Patent [19]

MacPhee

Best Available Copy

[11] 4,373,466

[45] Feb. 15, 1983

[54] STOREROOM BIN MARKER

[76] Inventor: Ralph G. MacPhee, 1209 Fremont Hill Dr., Selah, Wash. 98942

[21] Appl. No.: 200,391

[22] Filed: Oct. 24, 1980

[51] Int. Cl.[3] ..... G09F 3/20; G09F 9/00

[52] U.S. Cl. ..... 116/315; 40/16.4; 116/318; 235/88 R

[58] Field of Search ..... 116/315, 312, 313, 309, 116/318, 319, 306, 324; 40/325; 248/542

[56] References Cited

U.S. PATENT DOCUMENTS

| | | | |
|---|---|---|---|
| 372,559 | 11/1887 | Neely | 40/325 |
| 768,689 | 8/1904 | Poli | 116/315 X |
| 1,525,796 | 2/1925 | Bliss | 116/315 |
| 2,533,883 | 12/1950 | Gelb | 116/318 |
| 2,610,604 | 9/1952 | Edwards | 116/319 |
| 2,688,201 | 9/1954 | Troendle | 40/16 |
| 2,803,213 | 8/1957 | Smith | 116/314 |
| 3,297,249 | 1/1967 | Light | 116/318 |
| 3,304,907 | 2/1967 | Block | 116/315 |
| 3,862,506 | 1/1975 | Drenten et al. | 40/325 |
| 3,903,837 | 9/1975 | Barton et al. | 116/315 |
| 3,973,514 | 8/1976 | Patrick | 116/315 |
| 4,067,127 | 1/1978 | Klaus | 40/325 X |
| 4,220,309 | 9/1980 | Eisen et al. | 248/542 |

*Primary Examiner*—Daniel M. Yasich

*Attorney, Agent, or Firm*—Gregory W. Moravan; David H. Deits; Don R. Mollick

[57] ABSTRACT

A storeroom bin marker which includes a base member having indicia thereon, and a rotatable view blocking member which can be selectively rotated to cover some, all, or none of the indicia, to thereby indicate the supply or reorder status of a stocked item. The base member has front and top panels at right angles with respect to each other, and is designed to fit over the front and top edges of a storage shelf. The bin marker has mounting holes in its front and top panels which can be used, with an elastic cord member, to secure the bin marker to wire shelves; or which can be used with screws to secure the bin marker to a solid shelf. Alternatively, the bin marker can be adhesively mounted to solid shelves. The front panel of the bin marker is provided with a pair of parallel, spaced apart bin label retainers for releasably holding a replaceable bin label. The top panel tapers in thickness towards its free end to avoid snagging of stocked items on it when they are removed from the shelf; and the free end of the top panel projects downwardly to allow the bin marker to seat firmly on shelves of the type having an upwardly extending article retaining lip on their top front edge.

11 Claims, 6 Drawing Figures

STOREROOM BIN MARKER

FIELD OF THE INVENTION

The present invention relates generally to storeroom bin markers, and more particularly to an easily installed storeroom bin marker for wire or solid shelves. The bin marker can hold a bin label and can indicate the supply and reorder status of a stocked item.

BRIEF SUMMARY OF THE INVENTION

In the management and operation of an efficient, well organized storeroom, there has been a long felt need for a practical bin marker which is easy to use and yet is inexpensive, durable and reliable; which can be easily secured to either solid or wire shelves; which will accept and hold a replaceable bin label; and which will clearly indicate the supply and reorder status of a stocked item. Accordingly, the primary object of the present invention is to provide a bin marker which will satisfy at least all of these requirements.

In basic form, the storeroom bin marker of the present invention comprises a base member having top and front panels extending at right angles with respect to each other. The top and front panels are adapted to fit over, respectively, the front and top edges of a shelf for holding articles, thus aiding in the easy installation of the bin marker.

The front panel has two adjacent indicia located thereon, each in the form of a sector of a circle, with their combined size being a sector of less than about 180 degreees. A rotatable view blocking member, also in the form of a sector of a circle of less than about 180 degrees is secured to the front panel. The view blocking member is selectively rotatable to a first position in which it covers all of the indicia, to indicate an adequate supply of the stocked item; to a second position in which it exposes all of the indicia, to indicate that the minimum stock level of the stocked item has occurred and that a reorder is necessary; and to a third position in which only one indicia is left uncovered, to indicate that the necessary reorder has been placed, but not yet filled.

The front panel also includes a pair of spaced apart, parallel bin label holders used to releasably hold a bin label upon which can be written such information as the name of the stocked item and the predetermined minimum stock inventory level for that stocked item which, when reached, indicates that a reorder is necessary.

In order to achieve the object that the top panel of the bin marker interfere as little as possible with the removal of stocked items from the shelf upon which the bin marker is located, the top panel is tapered towards its free end to reduce any tendency it might have to snag the stocked times as they are removed from the shelf.

As is known, some storeroom shelves have an upwardly extending bead across the top of their front edge to help prevent the stocked items stored thereon from falling off. The free end of the top panel of the bin marker has a downwardly projecting lip which compensates for the bead on such shelves and permits the level mounting of the bin marker despite said bead. Of course, the top panel of the installed bin marker does project somewhat upwardly from the top of the front edge of the shelf upon which it is located, thereby enabling it to help to prevent any stocked items stored on the shelves from falling off.

The bin marker of the present invention must be easily mounted in order to best serve the needs of storeroom personnel. Accordingly, the bin marker can be adhesively secured to wire or solid storeroom shelves. In addition, the top and front panels of the bin marker have mounting holes to assist its being screwed in place to a solid shelf. Further, the mounting holes, along with a unique elastic cord having an engagement means at each end, can be used to secure the bin marker to wire shelves.

It should be understood that the foregoing is but a brief summary of the present invention, and is not intended to be a detailed catalog of its various objects, features, advantages and characteristics since these and further objects, features, advantages and characteristics of the storeroom bin marker of the present invention will be apparent from the following more detailed description thereof.

DETAILED DESCRIPTION OF THE PREFERRED EMBODIMENTS

Figure 1:
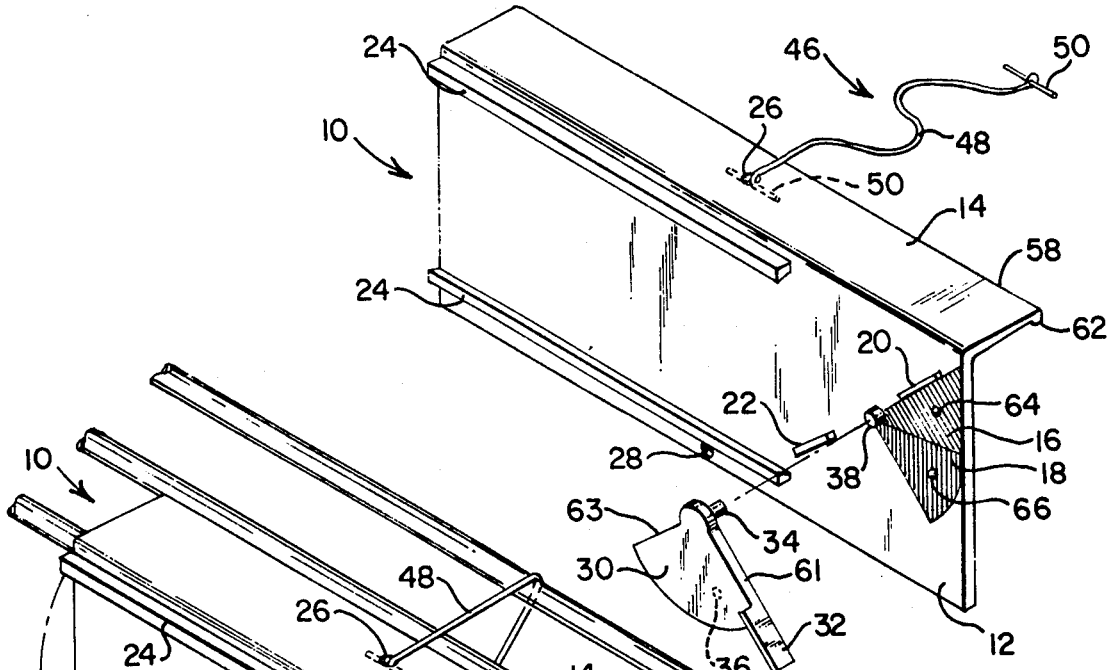
FIG. 1 is an exploded perspective view of one form of the storeroom bin marker of the present invention.

Referring now to FIGS. 1–4, the storeroom bin marker of the present invention, generally designated at 10, has a base member comprising front and top panels 12, 14, respectively, which extend at generally right angles with respect to each other. Located on the front panel are contrasting upper and lower indicia 16, 18, respectively, each indicia 16, 18 being generally in the form of a sector of a circle. Preferably the indicia 16, 18 are sized so their combined area is a sector of a circle of less than about 180 degrees.

Extending outwardly from the front panel 12 are upper and lower stops 20, 22, respectively; as well as a pair of outwardly extending, parallel, spaced apart, bin label holders 24. Formed in the top and front panels are upper and lower mounting holes 26, 28, respectively. Upper and lower stop bumps 64, 66, respectively, are located on the front panel 12, as is a mounting hole 38.

The view blocking member 30, has a handle 32, a mounting pin 34, and a stop recess 36. The body of the view blocking member 30 is generally in the form of a sector of a circle which is less than about 180 degrees and which is generally at least as large as the combined sectors of the indicia 16, 18. It is preferred that the handle 32 be sized such that when the view blocking member 30 is rotated so that its right side 61 contacts the upper stop 20 the handle 32 will not protrude above the top surface of the upper panel 14, so as not to interfere with the removal of articles from the shelf 44 or 52.

Preferably, the view blocking member 30, and the base member which includes the front and top panels 12, 14, with all their associated parts mentioned above, are each separately molded as independent units from any suitable plastic by any conventional molding technique.

The view blocking member 30 is mounted for rotation on the front panel 12 by inserting its mounting pin 34 into the mounting hole 38 in the front panel 12. Then, the end of its mounting pin 34 is flattened to form a retaining cap 40, best seen in FIG. 4, as by applying heat thereto by any conventional means.

Figure 2:
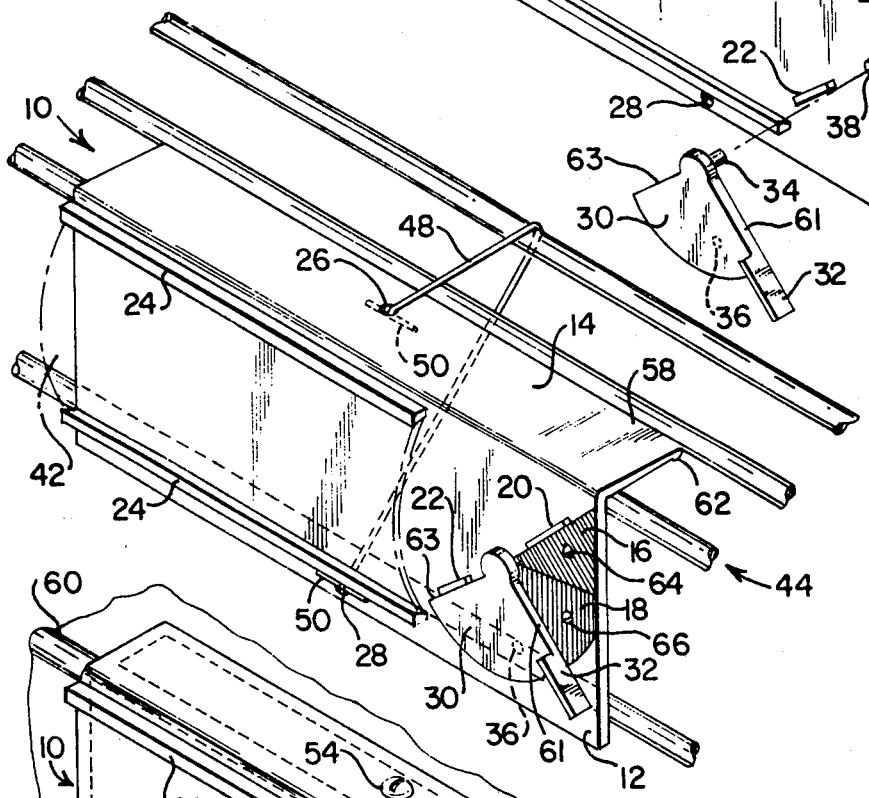
FIG. 2 is a perspective view thereof shown secured to a wire shelf.

As best seen in FIG. 2, the bin label holders 24 can be used to releasably hold a bin label 42 upon which can be marked the name of the item being stocked, as well as other information such as the predetermined minimum inventory level which has been set for that item.

Referring now to FIGS. 1 and 2, in order to mount the bin marker 10 to a wire shelf, generally designated at 44, an elastic cord, generally designated at 46, is used which has an elastic body 48 with a metal tip 50 secured to each end thereof. Naturally, each metal tip is passed through a respective mounting hole 26, 28 after which it can be oriented transversely with respect to the mounting hole to secure that end of the elastic body 48 thereto. The bin marker 10 could be secured to the wire shelf 44 by using one or more adhesive strips, not illustrated, located between the bin marker 10 and the wire shelf 44.

Figure 3:
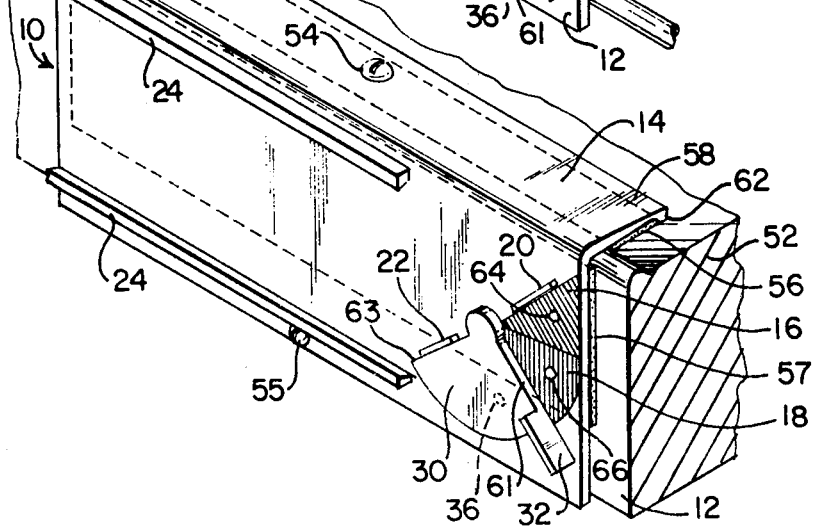
FIG. 3 is a perspective view thereof showing it secured to a solid shelf.
Figure 4:
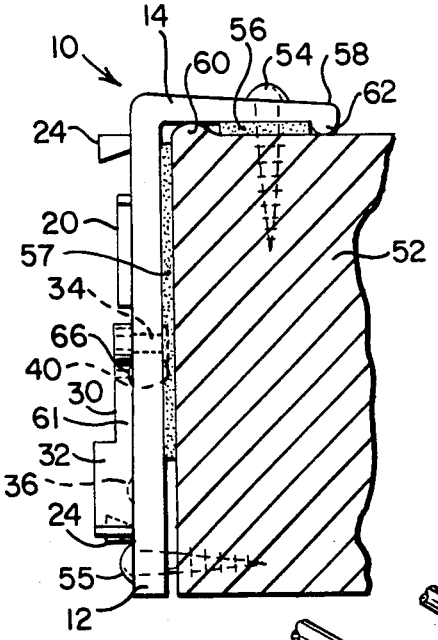
FIG. 4 is a side view of FIG. 3.

As best seen in FIGS. 3 and 4, the bin marker 10 can be secured to a solid shelf 52 by the use of upper and lower screws 54, 55 which are passed through respective mounting holes 26, 28; or upper and lower adhesive strips 56, 57, respectively, could be used. The screws 54, 55 or adhesive strips 56, 57 could be used alone. The term solid shelf is used herein in the sense of a shelf which has a substantially continuous front and top face, whether the shelf be formed from sheet metal, wood, etc.; to contrast the term solid shelf from the wire shelf 44 seen in FIG. 2.

Referring now to FIG. 4, it is seen that the top panel 14 generally tapers in thickness from its intersection with the front panel 12 towards its free end 58. This tapering of the top panel is used to help prevent any snagging of a stocked item as it is being removed from the storeroom shelf 44 or 52. Again, as best illustrated in FIGS. 3 and 4, many storeroom shelves have an upwardly extending bead 60 located at the top of their front edge to help prevent stocked items from inadvertently rolling or falling off the shelf. To assist in the secure mounting of the bin marker 10 to such a shelf, the free end 58 of the top panel 14 is provided with a downwardly extending lip 62 which compensates for the bead 60 and permits the secure, level mounting of the bin marker 10. The lip 62 also provides a recess, in conjunction with the shelf bead 60, within which the upper adhesive strip 56 can be located.

Now that a description of the physical construction and mounting of the bin marker 10 shown in FIGS. 1–4 has been given, a description of its operation in indicating the supply and reorder status of a stocked item wil be undertaken.

When a count of a stocked item is taken which indicates that the supply thereof is above any predetermined minimium, the view blocking member 30 is rotated until its right edge 61 contacts the upper stop 20. The view blocking member is held in this position by its stop recess 36 engaging a corresponding upper stop bump 64 on the front panel 12. In this position the view blocking member covers both the upper and lower indicia 16, 18, thereby blocking them from view, to indicate an adequate supply of the stocked item.

When a count of the particular stocked item being monitored by the bin marker 10 is made which reveals that the supply is less than the predetermined minimum, the view blocking member 30 is then rotated clockwise until its left edge 63 contacts the lower stop member 22, at which time both the upper and lower indicia 16, 18 are exposed to view. The view blocking member 30 is held in this position by the friction of its mounting pin 34 in its mounting hole 38 in the front panel 12, as well as by the off-center weight of its handle 32. For example, the lower indicia 18 may be colored red to indicate that the minimum predetermined stock level of the stocked item has been reached and that a reorder to the supplier needs to be made.

When the reorder has been made, the view blocking member 30 is then rotated counterclockwise until its stop recess 36 engages the lower stop bump 66, thereby holding the view blocking member 30 in a position such that it covers the lower indicia 18 and exposes the upper indicia 16. The upper indicia 16 may be colored green, for example, and indicates that the reorder of the necessary stocked item has been initiated, but that the shipment of the reordered stocked item has not, as of yet, been received.

When the new supply of the stocked item comes in, the view blocking member 30 is again rotated counterclockwise until its right edge 61 contacts the upper stop 20 and its stop recess 36 engages the upper stop bump 64, thereby concealing both the indicia 16, 18 from view and indicating that at least the minimum predetermined stock level of the stocked item is presently on hand.

It should be carefully noted that from the foregoing it will be apparent that the present invention has important advantages over some prior art dial type indicator devices of the type having a cover which is rotatable through 360 degrees, with the cover having an arcuate viewing hole therein, such as that disclosed in U.S. Pat. No. 3,903,837 to Barton et al. Such devices always need visual confirmation, after the dial is rotated, to see whether the dial's viewing hole is aligned so as to uncover the proper indicia.

On the other hand, in two of the three positions of the view blocking member 30 of the present invention, the view blocking member can be rotated by feel alone to the proper desired position, without the need for visual verification. That is, when the supply of the stocked item being monitored is adequate, the view blocking member 30 is rotated until its right edge 61 contacts the upper stop 20, at which time further rotation is impossible, and the view blocking member is then automatically held in this position by its stop recess 36 engaging the upper stop bump 64 so it covers all of the indicia. Similarly, when the supply of the stocked item being monitored is such that it is necessary that a reorder be made, the view blocking member 30 is rotated until its left edge 63 contacts the lower stop 22, at which time further rotation of the view blocking member is again impossible, and the view blocking member is automatically held in this position by friction and by the offcenter weight of its handle 32, that has been previously described, so that it covers none of the indicia.

Thus, only when the view blocking member 30 is rotated to its intermediate position so that its stop recess 36 engages the lower stop bump 66 is it necessary that there be visual confirmation that the view blocking member has been rotated to the proper position so that only the lower indicia 18 is covered. Thus we see that in two of the three positions of the view blocking member 30 no visual confirmation is needed to insure its proper positioning, thereby enhancing the ease and accuracy with which the present invention can be used.

It should be noted that it is within the scope of the present invention, although not illustrated, for the top panel 14 of the bin marker 10 to be eliminated. In such case, the bin marker would have to be adhesively secured to the wire rack 44 illustrated in FIG. 2 since the elastic cord 46 could not be used; and would have to be secured with only the lower mounting screw 55 and/or the lower adhesive strip 57 to the solid shelf 52 illustrated in FIGS. 3 and 4.

Figure 5:
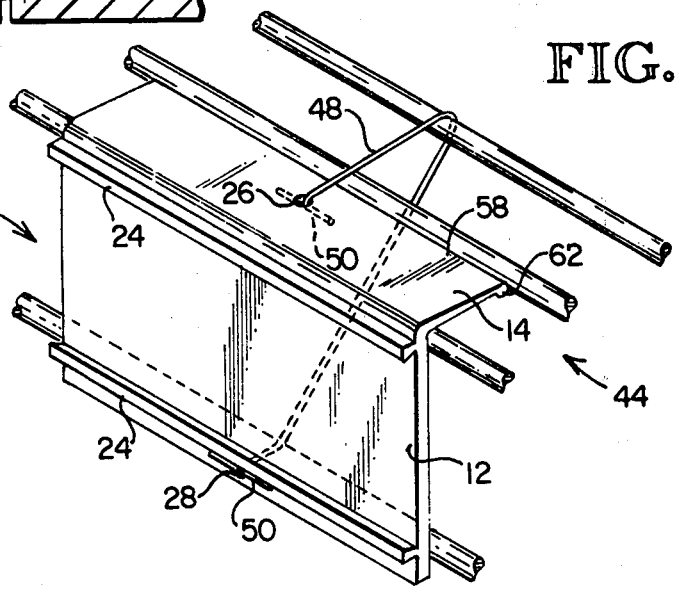
FIG. 5 is a perspective view of a second form of the present invention shown secured to a wire shelf.

Turning now to the second form of the present invention, generally designated at 70, which is illustrated in FIG. 5, it is noted that it is identical to the form 10 illustrated in FIGS. 1–4 except that the bin marker 10 has been shortened, thereby eliminating the view blocking member 30, the upper and lower stops 20, 22, the mounting hole 38, the upper and lower indicia 16, 18, and the upper and lower stop bumps 64, 66. Accordingly, the same reference numerals have been used to identify parts of the form 70 shown in FIG. 5 which correspond to those of the form 10 in FIGS. 1–4.

Although not illustrated, the form 70 could be mounted to a solid shelf 52 with upper and lower mounting screws 54, 55 and/or with upper and lower adhesive strips 56, 57, as was the form 10 of FIGS. 1–4.

In addition, the top panel 14 of the form 70 of FIG. 5 could be eliminated. Of course, then the form 70 would have to be mounted to the wire shelf 44 by adhesive strips (not illustrated) located between its front panel 12 and the wire rack 44, since the elastic cord 46 could not be used. Similarly the form 70 without a top panel 14 would have to be mounted to a solid shelf 52 by the lower mounting screw 55 through its lower mounting hole 28, and/or by use of the lower adhesive strip 57.

Figure 6:
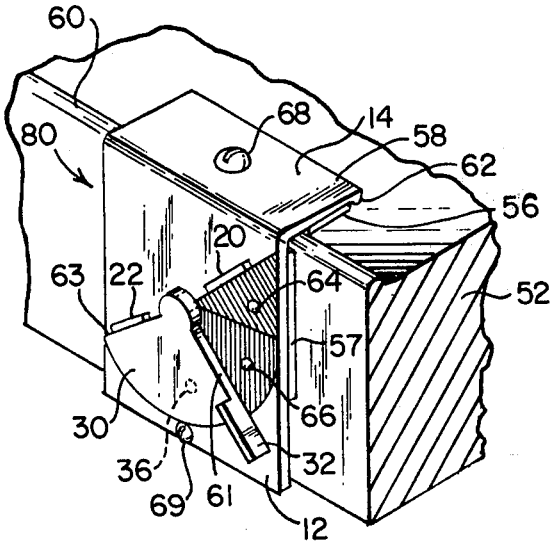
FIG. 6 is a perspective view of a third form of the present invention shown secured to a solid shelf.

Turning now to the third form of the invention, generally designated at 80, shown in FIG. 6, it is seen that it is identical to the embodiment shown in FIGS. 1–4 except that the left portion of the bin marker 10 has been eliminated, along with the bin label holders 24, the upper and lower mounting holes 26, 28 and the upper and lower mounting screws 54, 55. Accordingly, like elements of the invention 80 shown in FIG. 6 which correspond to those of the form 10 shown in FIGS. 1–4 have been given the same reference numerals. The only change is that the form 80 of the invention shown in FIG. 6 is secured to the shelf 52 by upper and lower mounting screws 68, 69 which pass through corresponding mounting holes in the top and front panels 12, 14. Naturally, the form 80 of FIG. 6 could be mounted to a wire shelf 44 by the use of an elastic cord 46, whose metal tips 50 are passed through the mounting holes for the screws 68, 69, in the manner previously described with respect to the form 10 shown in FIGS. 1–4.

In addition, it is contemplated that the top panel 14 of the form 80 shown in FIG. 6 could be eliminated, thereby necessitating the use of adhesive strips to secure it to a wire shelf 44 since the elastic cord 46 could not be used. To mount such a modified form 80 to a solid shelf 52, the lower mounting screw 69 and/or adhesive strip 57 could be used.

It is to be understood that the bin marker of the present invention may be embodied in other specific forms without departing from the spirit and essential characteristics described herein. The present embodiments are therefore to be considered in all respects as illustrative and not restrictive, the scope of the invention being indicated by the appended claims rather than by the forgoing description, and all changes which come within the meaning and range of equivalency of the claims are therefore to be embraced therein.

What is claimed is:

1. A storeroom bin marker comprising:

a base member means having located thereon at least two indicia means; and a view blocking means mounted to said base member means for rotation about an axis generally perpendicular to said base member means, so said view blocking means rotates in a plane generally parallel to said base member means; wherein said view blocking means is sized and located on said base member means in a way such that in a first position said view blocking means covers all of said indicia means, in a second position said view blocking means does not cover at least one of said indicia means, and in a third position said view blocking means does not cover any of said indicia means; and wherein said bin marker further comprises means for releasably holding said view blocking means in said first and second positions.

2. The bin marker according to claim 1, wherein each of said indicia means is a sector of a circle of less than 180 degrees; and wherein said view blocking means is a sector of a circle at least about as large as the combined sectors of said indicia means, and is a sector of less than about 180 degrees.

3. The bin marker according to claim 1, wherein said axis of rotation of said view blocking means is located near one edge of said view blocking means and said indicia are positioned to one side of said axis of rotation of said view blocking means in a location such that when said view blocking means are rotated to said third position, gravity will hold it in said third position while it covers none of said indicia means.

4. The bin marker according to claim 1, wherein said base member means includes a pair of stop means extending outwardly from its surface; wherein one of said stop means is located so as to stop the rotation of said view blocking means in a position where it covers at least substantially all of said indicia means; and wherein the other of said stop means is located so as to stop the rotation of said view blocking means in a position where it covers at least substantially none of said indicia means.

5. The bin marker according to claim 1, wherein said bin marker is designed not to interfere with the removal of articles from a storage shelf for articles, wherein said base member means has first and second sides disposed at right angles with respect to each other; wherein said indicia means and said view blocking means are located on said first side; and wherein said first and second sides are adapted to fit over, respectively, the front and top of said storage shelf for articles.

6. The bin marker according to claim 5, wherein said second side tapers in thickness from its intersection with said first side to its free end, to help prevent any snagging of its free end with articles being removed from said shelf.

7. The bin marker according to claim 5, wherein the free end of said second side terminates in a downwardly extending lip which is adapted to help said second side fit over the article retaining bead found on the top edge of some shelves so that said second side is supported by said lip and said bead for the secure mounting of said bin marker.

8. The bin marker according to claim 1, wherein said base member is elongated and includes a pair of spaced apart, parallel bin label holder means which are spaced laterally away from said indicia means and said view blocking means; and wherein said bin label holder means are adapted to receive and releasably hold a bin label.

9. A bin marker according to claim 1, further comprising:

a second side oriented at generally a right angle with respect to said base member means, wherein said base member means and said second side are adapted to fit over, respectively, the front and top of a storage shelf for articles; and a pair of spaced apart, parallel bin label holder means which are spaced laterally apart, and which are adapted to receive and releasably hold a bin label, wherein said bin marker is designed not to interfere with the removal of said articles from said storage shelf.

10. The bin marker according to claim 9, wherein said second side tapers in thickness from its intersection with said base member means to its free end to help prevent any snagging of its free end with articles being removed from said shelf.

11. The bin marker according to claim 9, wherein the free end of said second side terminates in a downwardly extending lip which helps said second side fit over the article retaining bead found on the top edge of some shelves so that said second side is supported by said lip and said bead for the secure mounting of said bin marker.

* * * * *